US010273840B1

(12) United States Patent
Harmon, Sr.

(10) Patent No.: US 10,273,840 B1
(45) Date of Patent: Apr. 30, 2019

(54) HIGH EFFICIENCY STEAM ENGINE AND IMPACT-FREE PISTON OPERATED VALVES THEREFOR

(71) Applicant: Thermal Power Recovery LLC, Mahtomedi, MN (US)

(72) Inventor: James V. Harmon, Sr., Mahtomedi, MN (US)

(73) Assignee: Thermal Power Recovery LLC, Mahtomedi, MN (US)

( * ) Notice: Subject to any disclaimer, the term of this patent is extended or adjusted under 35 U.S.C. 154(b) by 0 days.

(21) Appl. No.: 15/794,486

(22) Filed: Oct. 26, 2017

(51) Int. Cl.

| | |
|---|---|
| ***F01K 23/06*** | (2006.01) |
| ***F01K 27/00*** | (2006.01) |
| ***F01K 13/00*** | (2006.01) |
| ***F01B 1/00*** | (2006.01) |
| ***F01L 21/02*** | (2006.01) |
| ***F01L 21/04*** | (2006.01) |
| ***F01B 17/04*** | (2006.01) |

(52) U.S. Cl.
CPC ..... *F01L 21/04* (2013.01); *F01B 17/04* (2013.01); *F01L 21/02* (2013.01)

(58) Field of Classification Search
CPC . F01L 21/04; F01L 21/02; F01L 9/026; F01L 2009/043; F01L 2009/0432; F01B 17/04; F01B 2250/001; F01B 9/02; F01B 31/28
USPC ..... 60/670, 712, 643, 676; 91/152, 184, 228
See application file for complete search history.

(56) References Cited

U.S. PATENT DOCUMENTS

| | | | | |
|---|---|---|---|---|
| 1,090,417 A | | 3/1914 | Schmidt | |
| 1,167,527 A | | 1/1916 | Schmidt | |
| 1,514,504 A | | 11/1924 | Cohen | |
| 2,295,962 A | | 9/1942 | Mueller | |
| 2,402,699 A | | 6/1946 | Williams | |
| 2,757,644 A | * | 8/1956 | Smith | F01B 17/04 91/228 |
| 2,922,402 A | * | 1/1960 | Ballard | F01B 17/04 91/176 |
| 2,943,608 A | | 7/1960 | Williams | |
| 3,279,326 A | | 10/1966 | Harvey et al. | |
| 3,361,036 A | * | 1/1968 | Harvey | F01B 17/04 91/224 |
| 3,397,619 A | | 8/1968 | Sturtevant | |

(Continued)

FOREIGN PATENT DOCUMENTS

| | | | | |
|---|---|---|---|---|
| CN | 200999662 Y | * | 1/2008 | |
| DE | 2405380 A1 | * | 8/1975 | F01K 21/02 |

(Continued)

*Primary Examiner* — Thai Ba Trieu
(74) *Attorney, Agent, or Firm* — Thomas J. Nikolai; Nikolai & Mersereau, P.A.

(57) ABSTRACT

A high efficiency variable cutoff uniflow steam engine with piston operated valves has an exhaust valve that is held open by a spring during the exhaust stroke but is closed at an end of the exhaust stroke by the piston compressing steam in a compartment associated to act on the exhaust valve. The piston continues to move in the same direction a short distance toward top dead center (TDC) compressing a small residual quantity of steam in the cylinder above the piston during the remaining fraction of the exhaust stroke with sufficient pressure to open the steam inlet valve by steam pressure without an impact caused by physical contact with the piston.

18 Claims, 7 Drawing Sheets

(56) References Cited

U.S. PATENT DOCUMENTS

| | | | | | |
|---|---|---|---|---|---|
| 3,638,533 | A * | 2/1972 | Sheridan | F01B 17/04 91/273 |
| 3,668,974 | A * | 6/1972 | Hagdorn | F01B 17/04 91/242 |
| 4,041,838 | A * | 8/1977 | Warren | F01L 1/30 91/273 |
| 7,367,785 | B2 | 5/2008 | Roberts | |
| 8,448,440 | B2 | 5/2013 | Peoples et al. | |
| 8,661,817 | B2 | 3/2014 | Harmon, Sr. et al. | |
| 9,316,130 | B1 | 4/2016 | Harmon, Sr. et al. | |
| 9,657,568 | B2 | 5/2017 | Bielenberg | |
| 9,784,147 | B1 | 10/2017 | Harmon, Sr. | |
| 2012/0324889 | A1* | 12/2012 | Petitjean | F01B 29/04 60/645 |

FOREIGN PATENT DOCUMENTS

| | | | | | |
|---|---|---|---|---|---|
| GB | 2267127 | A * | 11/1993 | F01K 21/02 |
| JP | 359099016 | A | 6/1984 | |
| WO | WO 2008034544 | A2 * | 3/2008 | F01L 11/02 |
| WO | WO 2013026260 | A1 * | 2/2013 | F02B 41/06 |

* cited by examiner

FIG. 2

STEAM CONSUMPTION RATE OF THE INVENTION AND HIGH COMPRESSION ENGINE*

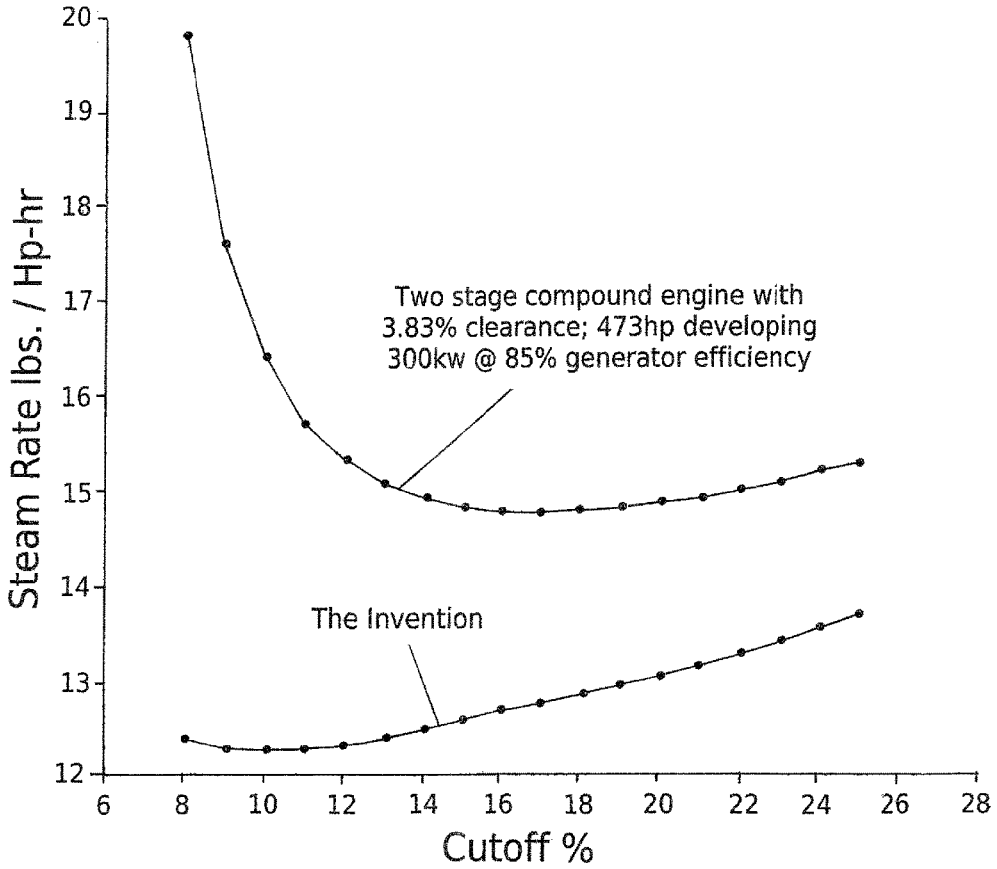

CONDITIONS:

| | | | |
|---|---|---|---|
| SUPPLY STREAM TEMRERATURE, R | = | 960.0 | 260°C |
| THROTTLE PRESSURE, psia | = | 363.0 | 25 Bar |
| COMPRESSION PRESSURE, psia (HCU) | = | 363.5 | 25 Bar |
| ENTHALPY CHANGE THROUGH GENERATOR | = | 1150.0 | Btu/lb. |
| CONDENSER SUCTION PRESSURE, psia | = | 7.25 | .5 Bar |
| COMPRESSIBILITY @ TS | = | 0.918 | |

*Assume 70% pump efficiency; Friction Assume $\frac{\text{.5ft-lb Torque}}{\text{In.}^3 \text{ displacement}}$

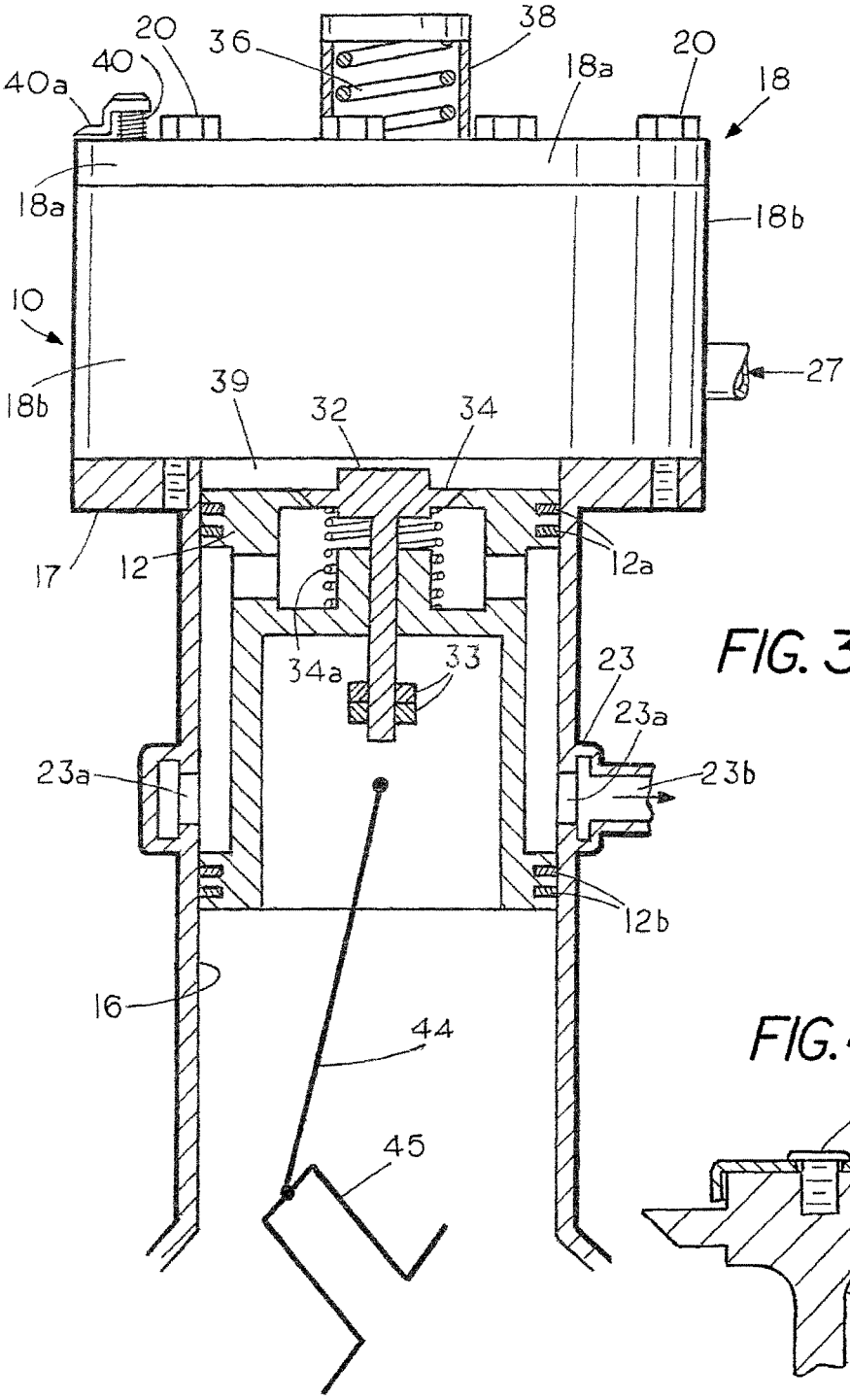
FIG. 3
FIG. 4
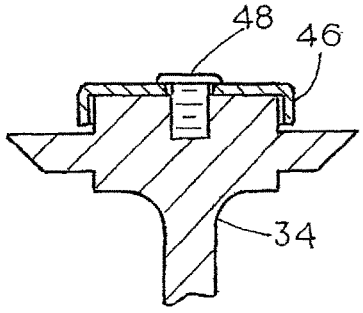

70
70c
70a
70b
20
63b
16
47
65
64
65a
62d
62
60
61
65b
63
66
12
56
51a
58
70
71
52
51
52b
58b
72
73
74
51b
51c
72a
71a
51
52a
58a
59a
50
54
59
53a
53b
53
20
18
17

HIGH EFFICIENCY STEAM ENGINE AND IMPACT-FREE PISTON OPERATED VALVES THEREFOR

I. CROSS REFERENCE TO RELATED APPLICATIONS

The present application is a continuation-in-part of application Ser. No. 15/077,576, now U.S. Pat. No. 9,828,866 B1, which is a continuation-in-part of application Ser. No. 13/532,853 filed Jun. 26, 2012, now U.S. Pat. No. 9,316,130, which is in turn a continuation-in-part of Ser. No. 12/959,025, filed Dec. 2, 2010, now U.S. Pat. No. 8,448,440.

II. FIELD OF THE INVENTION

This invention relates to high efficiency steam engines and improved valves for such engines.

III. BACKGROUND OF THE INVENTION

Much of the epic progress during the industrial revolution in the United States during the $19^{th}$ and $20^{th}$ century was powered by steam. However, the thermal efficiency of steam powered piston engines could not match that of the Otto or Diesel engines developed at the end of the $19^{th}$ century. A substantial improvement in steam engine efficiency was however made when the uniflow steam engine was developed by Professor Stumpf in Germany and improved further in the U.S. by C. C. Williams high compression uniflow engine based on compression as described in U.S. Pat. Nos. 2,402,699 and 2,943,608 in which steam is compressed to boiler pressure by the piston return stroke thereby raising the steam temperature for example 95 to 342 degrees hotter than feed steam in a sizeable clearance volume that may be 7% to 14.5% of displacement. The thermal efficiency of even these engines while improved, could not however reach that of the internal combustion engine.

Recently, a substantial advance has been made through the development of steam engines operating on a cycle that employs essentially zero clearance between the piston and the cylinder head at the end of the exhaust stroke while at the same time any steam in the cylinder is under little or no compression. This arrangement achieves a remarkable increase in thermal efficiency as disclosed in U.S. Pat. Nos. 8,448,440, 9,316,130, 8,661,817 and application Ser. No. 15/077,576 (now U.S. Pat. No. 9,828,866 B1) which are assigned to the Applicant's assignee and incorporated herein by reference. Engines in which both piston clearance and compression approach zero (the Z-Z operating principle) described in the patents noted provide a thermal efficiency which is from about 15% better to an extraordinary 59% better than the best performing high compression uniflow engines known (see FIG. 1). The outstanding efficiency of these engines relies in part upon the Z-Z operating principle and in part upon benefits arising from the use of a unique, fast acting inlet valve which can open fully in some embodiments in less than 1 millisecond thereby avoiding losses formerly caused by flow restriction through the inlet valve while the valve is being opened by a cam as in prior cam and eccentric operated engines in which the opening process may take as much as ⅓ to ¾ of a crankshaft rotation during which time the steam pressure rises relatively slowly in the expansion chamber causing a reduction in power output. By contrast, since the inlet valve of Z-Z engines and the present invention is opened almost instantly while the clearance is virtually zero, work output of the engine begins at steam supply pressure earlier in the cycle thereby providing more power without a compression loss. However, in the Z-Z engine patents and other engines using a bump valve, as the valve lifter on the piston makes physical contact with the valve to apply a lifting force a small impact occurs; but because the piston velocity falls to zero very close to when the lift takes place in the Z-Z patents only a few degrees before TDC with a small clearance of 0.020 inch, the impact of the lifter as it contacts the valve is acceptable in many applications but may not be acceptable in all applications.

Accordingly, it is one major aim of the present invention to retain the high efficiency and other advantages of the Z-Z engine patents noted above while finding a way to actuate valves by piston movement so as to avoid valve wear and noise as well as being able to operate valves rapidly, e.g., open the inlet fully in under 1 millisecond. By achieving these objectives in accordance with the present invention, the impact and associated shock wave characteristic of valves that are bumped open by piston contact are not simply reduced but are entirely eliminated along with the wear and clicking sound associated with prior valve lifters mounted on the piston, thereby rendering operation of the engines embodying the present invention very quiet while extending valve life almost indefinitely. Besides being quiet, the thermal efficiency of the engine described herein exceeds that of a steam turbine in medium to small sizes, especially those under 1000 horsepower and is lower in cost. These advantages make the invention particularly well-suited for applications such as electric power generation or the co-generation of heat and power as well as to power a vehicle or for use in solar power generation. A major advantage of the invention over internal combustion engines is the ability to use a variety of low grade fuels including waste or unrefined liquid fuels and biomass without producing harmful nitrogen compounds or other air polluting emissions generated by internal combustion engines.

In view of the deficiencies of the prior art it is one object to provide a way of actuating a steam inlet or exhaust valve by piston movement instead of a camshaft yet without producing an impact shock.

It is a more specific object to maintain the high thermal efficiency that characterizes the virtual zero or near zero pressure with zero clearance steam cycle of U.S. Pat. Nos. 8,448,440, 9,316,130 and pending application Ser. No. 15/077,576, now U.S. Pat. No. 9,828,866 B1 without the use of a camshaft for operating either a steam inlet or exhaust valve and without the need to actuate a valve by applying an opening pressure through physical contact with a valve.

A further object is to maintain the exhaust valve open throughout almost the entire exhaust stroke yet find a way to develop a sufficient inlet valve opening force without impact to at least partially open the steam inlet valve as the piston approaches the top dead center position.

Another object is to provide a method that enables piston movement to readily achieve the force needed to open a poppet type of inlet valve without the use of a camshaft or a need to apply physical contact to push the valve open.

It is still another object to actuate the valves in a way that provides high thermal efficiency by maintaining a small clearance between the piston and cylinder head at top dead center while expending little work in opening or closing valves as well as to avoid having to open the inlet valve against steam supply pressure.

Yet another object is to find a way to almost simultaneously open an inlet valve and close an exhaust valve without the use of either a camshaft or a valve lifter element for exerting an opening or closing force on a valve through physical contact.

Another object is to operate valves noiselessly without the use of a camshaft, yet be able to set inlet valve cutoff timing at any value needed as well as the ability to provide continuous variable cutoff regulation under changing loads if desired to achieve a higher overall thermal efficiency than heretofore possible in a reciprocating steam engine.

These and other more detailed and specific objects and advantages of the present invention will be better understood by reference to the following figures and detailed description which illustrate by way of example but a few of the various forms of the invention within the scope of the appended claims.

SUMMARY OF THE INVENTION

This invention provides a high efficiency uniflow steam engine having a steam inlet and exhaust valves that communicate with a steam expansion chamber located in a cylinder between a piston and a cylinder head. The exhaust valve is held open by a spring during the exhaust stroke but is closed proximate an end of the exhaust stroke while the piston continues to move a short remaining distance toward top dead center (TDC) such that a residual quantity of relatively low pressure steam is compressed in the steam expansion chamber during the relatively small remaining terminal fraction of the exhaust stroke with sufficient cylinder pressure just prior to reaching TDC to open the steam inlet valve which is held closed by a spring. In one preferred form of the invention a valve actuation assembly is provided comprising a steam compression compartment defined between a plunger and a recess within the engine. The recess is closed at one end and open at the other end to receive the plunger with which it is aligned so that the plunger enters the recess through its open end due to movement of the piston so as to trap and pressurize steam within the recess and thereby close the exhaust valve with the steam thus pressurized acting as a cushion whereby a small remaining movement of the piston toward TDC brings the steam pressure in the steam expansion chamber itself high enough to open the steam inlet valve without an opening force applied by physical contact between the inlet valve and the piston. Thus the recess is pressurized first causing the exhaust valve to close which in turn leads to pressurization of the cylinder sufficient to force the inlet valve open by vapor pressure alone.

The invention also concerns a steam engine with a steam cutoff control valve inside a casing having a bypass prevention sleeve to direct steam in the cylinder to pass through the control valve within the casing rather than bypassing the control valve. The invention also concerns a unique steam inlet valve having a sealing element comprising a compression ring around the steam inlet valve that takes a position when the valve is closed between a steam inlet port and a valve seat for the inlet valve to prevent the possibility of high pressure steam from prematurely entering a valve seat area or lifting the inlet valve off its seat. The seal provided by the compression ring also delays opening of the steam inlet valve slightly even though the inlet valve is off its seat while the piston continues moving toward TDC thereby preventing counter-torque or kickback losses just prior to TDC.

BRIEF DESCRIPTION OF THE DRAWINGS

FIG. 2 graphs the rate of steam consumption calculated per horsepower hour for the invention at various cutoff settings compared with the corresponding performance of the most efficient high compression reciprocating uniflow steam engines previously known.

FIG. 3 is a side elevational view partly in section of the form of the invention shown in FIGS. 5-7.

FIG. 4 is an alternate form of plunger at the upper end of the exhaust valve of FIGS. 3 and 5.

All publications, applications and patents cited herein are incorporated by reference to the same extent as if each individual publication, application or patent were specifically and individually reproduced herein and indicated to be incorporated by reference.

Figure 1:
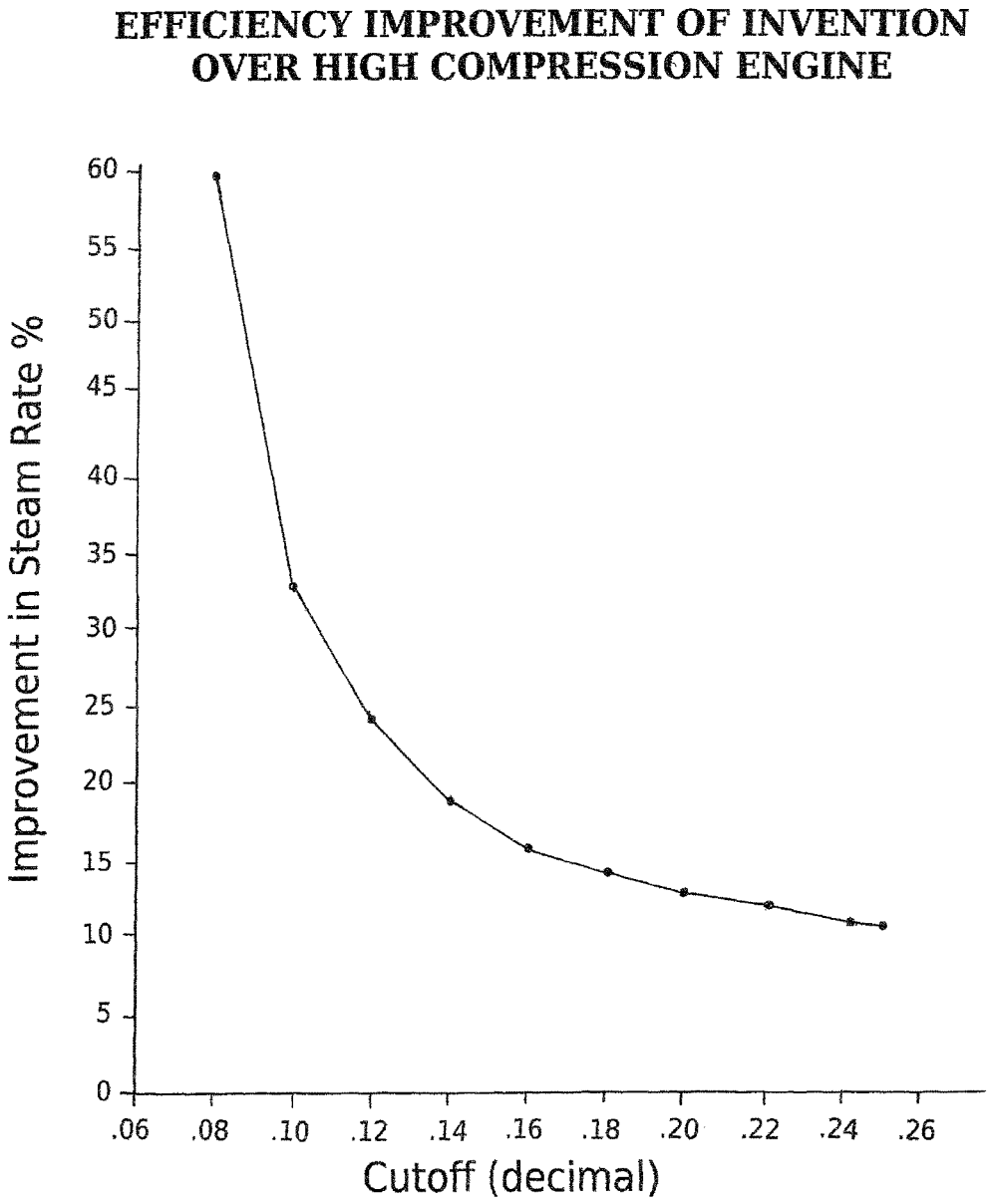
FIG. 1 is a graph showing the improvement in thermal efficiency of the invention over the prior art taken from the performance curves shown in FIG. 2.
Figure 5:
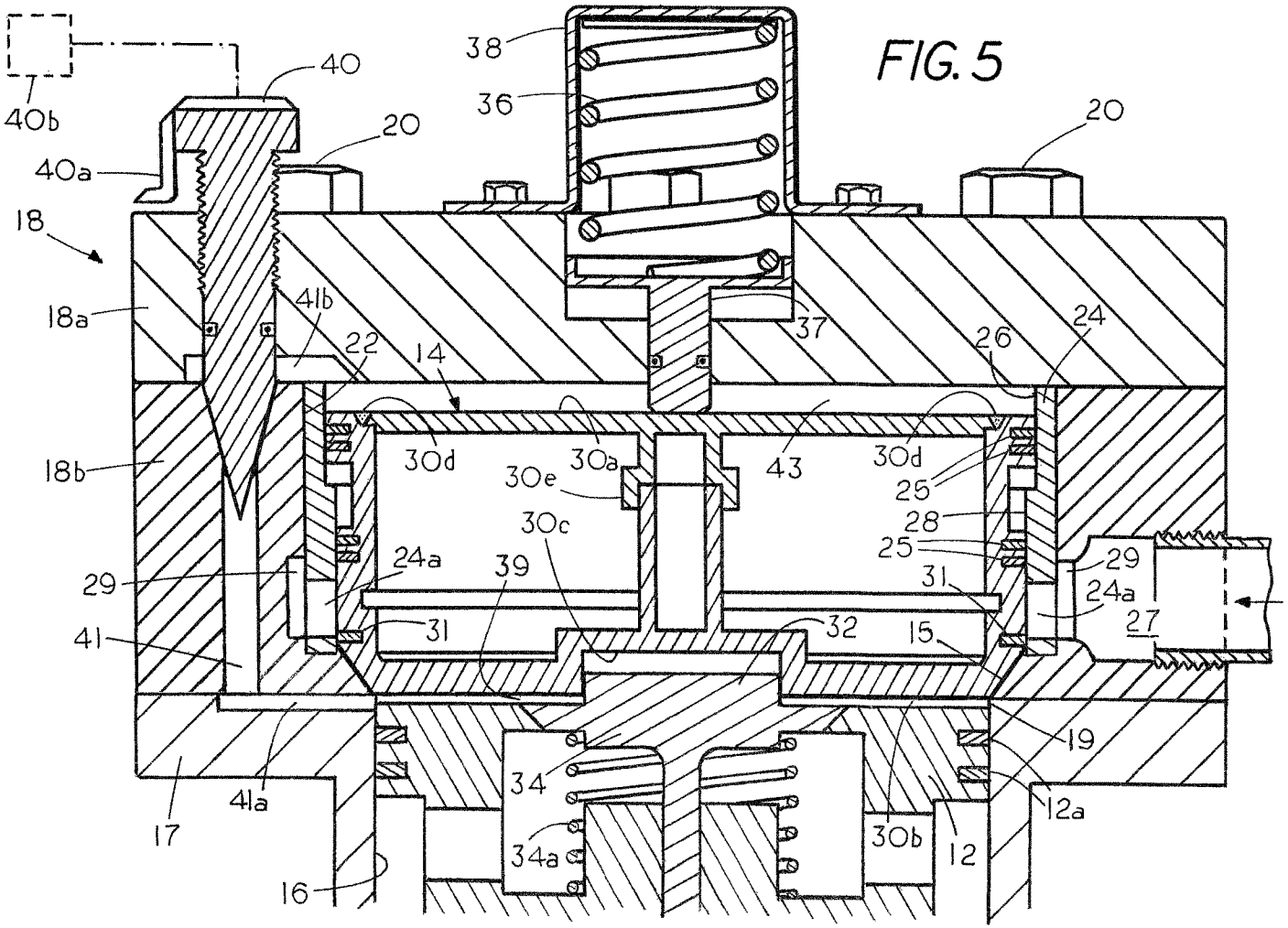
FIG. 5 is a vertical cross sectional view of the upper end of FIG. 3 on a larger scale.

Refer now to FIG. 1 which shows what is clearly a huge improvement in thermal efficiency provided by the present invention compared to the prior art. FIG. 1 shows that at a 16% cutoff the thermal efficiency of the invention is over 15% better, at 12% cutoff it is almost 25% better and at an 8% cutoff where the prior art is at or near a stall condition there is an extraordinary 59% improvement. In a typical steam engine the efficiency improves as the cutoff is lowered. FIG. 1 shows that to be the range where the present invention is the most effective.

FIG. 1 is derived from FIG. 2 which shows in the upper curve a 2 cylinder double expansion engine powered by biomass (wood) producing 473 hp to provide 300 KW @ 85% generator efficiency compared with an equivalent engine embodying the present invention in which both operate under the same conditions listed in FIG. 2. The term "steam rate" in the Figures refers to a computation of the pounds of steam consumed by an engine to produce a given power output based upon its operating characteristics and, of course, an inefficient engine consumes steam at a higher steam rate than an efficient one. For example in FIG. 2 the high compression compound engine of the prior art (upper line) at a 10% cutoff consumes 15.6 lbs.hp-hr compared with 12.3 lbs.hp-hr for the invention. The efficiency improvement of the invention (FIG. 1) over the prior art at different cutoff values is computed by comparing data in the curves shown in FIG. 2. The thermodynamics formulas used for computing the curves of FIG. 2 are given in Applicant's U.S. Pat. No. 8,448,440, Column 4, line 48 to Column 6, line 21.

DETAILED DESCRIPTION OF THE PREFERRED EMBODIMENTS

In FIGS. 3-7 is shown an engine 10 according to one form of the invention in which a piston 12 is approaching top dead center (TDC). Within the cylinder head 18 is a steam inlet valve 14 shown in a closed position on a tapered seat 15 that surrounds a valve opening 19 that is inward of valve 14 communicating with a cylinder 16 in which a piston 12 connected to a crankshaft 45 by a connecting rod 44 is slidably and sealingly mounted. The cylinder 16 has the same diameter as the inward valve opening 19 so that the inlet valve 14 has a somewhat larger diameter than the cylinder 16. The cylinder head 18 has an upper part 18*a* and a lower part 18*b* that are held together and secured to an engine block 17 by bolts 20. Within the cylinder head 18 is a cylindrical cavity 22 into which is pressed a circular valve sleeve 24 having an upper bore section 26 and a lower or inward bore section 28 of a slightly smaller diameter.

Slidably and sealingly mounted in the sleeve 24 is the steam inlet valve 14 which has a larger diameter section sealed by means of compression rings, i.e., commercially available piston compression rings 25 located in upper section 26 and a reduced diameter section also sealed by compression rings 25 of a smaller size in the smaller bore section 28 of sleeve 24. When valve 14 is opened, high pressure steam from a steam generator is supplied through a passage 27 to a circular counter bore 29 then through several ports 24*a* in sleeve 24 into a steam expansion chamber 39 within cylinder 16 above piston 12. Mounted on inlet valve 14 between the ports 24*a* and the valve seat 15 is an additional compression ring 31 that prevents steam from entering between the inlet valve and seat 15 when the valve is closed. The valve 14 is hollow with parallel upper and lower (i.e., outward and inward) walls 30*a* and 30*b* respectively that have parallel top and bottom surfaces. The wall 30*a* reduces the size and thus hastens filling of the cutoff control chamber 43 above valve 14. The inward wall 30*b* has a downwardly, i.e., inwardly opening cylindrical recess 30*c* into which a cylindrical outwardly extending plunger 32 at the free end of exhaust valve 34 is aligned so as to enter the recess 30*c* when the piston 12 approaches TDC for trapping and compressing a small amount of residual steam in the recess 30*c*. The positions of the recess and plunger which act together to define a valve actuation assembly can be reversed if desired. It will be noted that the inlet valve 14 is formed from two separate components welded together at 30*d* and has a central tubular support column 30*e* with upper and lower parts that fit together telescopically. An inlet spring 36 mounted in a housing 38 attached to the top of the cylinder head which presses down on a spring holder 37 to keep the inlet valve 14 in a normally closed position. Spring 36 is somewhat stronger than an exhaust valve spring 34*a* mounted in the piston. The exhaust valve spring 34*a* normally holds exhaust valve 34 open so that steam is exhausted throughout almost the entire exhaust stroke.

At TDC a small gap, e.g., most preferably at least 0.020-0.040 inch remains in both the expansion chamber 39 as wells as between the end of the plunger 32 and the opposed inner end wall of recess 30*c*. This prevents physical contact, impact or wear as pressure developed in steam being compressed in the recess 30*c* closes the exhaust valve against the opening force of the spring 34*a*. In one embodiment the exhaust is set to close when the piston is about 0.120 inch from TDC creating a sudden pressure rise in the steam expansion chamber 39 sufficient to at least partially open the inlet valve 14 by steam pressure instead of a bump whereupon high pressure supply steam will almost instantly drive the inlet valve 14 fully open by applying a much greater steam supply pressure assist force to the inward wall 30*b* of the inlet valve as the piston approaches closely, e.g., within about 0.020-0.030 inch but does not make physical contact with the inlet valve to assure silent, wear-free valve operation.

Because the inlet valve stroke is small, such as 0.10 or 0.20 inch, the work required to open it against a 30 or 40 pound spring 36 is very low. Moreover, the inlet valve 14 is not opened against supply pressure as in an ordinary bump valve since pressure in chamber 43 above valve 14 is at ambient conditions when opened. Valve service life could therefore be extended several million cycles (the equivalent of 100,000 miles in an automobile). By setting the clearance of both recess 30*c* and chamber 39 at TDC to a small dimension as described as well as beginning compression very late in the exhaust stroke, e.g., about 0.1 to 0.2 inch from TDC, the high efficiency of the Z-Z operating principle described herein can be achieved as the valves are operated without an impact shock.

A threaded needle valve 40 having a pointer 40*a* controls steam cutoff to the cylinder 16 by setting or by continuously electronically regulating, by means of an electronic control unit 40*b*, the flow rate of steam from the cylinder 16 through a passage 41*a* then through duct 41 past the needle valve 40 and through the passage 41*b* into the control chamber 43. The cutoff time is reduced as the valve 40 is opened further and vice and versa. The larger diameter section 26 enables the inlet valve 14 to close when steam pressure is equal at both ends of inlet valve 14 but to open almost instantly with a steam pressure assist when steam at supply pressure is admitted into the cylinder below valve 14 proximate an end of the exhaust stroke when there is little or no pressure in cutoff control chamber 43. The steam in the cutoff control chamber 43 above valve 14 falls to ambient pressure at the end of the exhaust stroke by flowing out through duct 41 and the milled passages 41*a* and 41*b*. The setting of lock nuts 33 (FIG. 3) establish the lift distance of valve 34 and the timing for the plunger 32 to enter the recess 30*c*.

If desired, in a simplified form of the invention, the ring 31 is eliminated as is the part of the sleeve 24 adjacent the counter bore 29. The remaining part of the sleeve 24 is made integral with the surrounding cylinder head 18*b*. The seal line of valve seat 15 is then concentrated at its outer edge by making valve seat 15 two degrees steeper than the opposed valve face.

The operation of the embodiment shown in FIGS. 3-7 will now be described. When the piston is at bottom dead center (BDC), steam escapes through preliminary uniflow exhaust ports 23*a* and exhaust pipe 23*b* allowing cylinder pressure to drop to ambient or condenser pressure. The exhaust valve spring then holds the exhaust valve open during the exhaust stroke to assure that there is no recompression of residual steam throughout almost the entire exhaust stroke. However, approaching TDC, the plunger 32 traps a small amount of the remaining low pressure steam in the recess in the inlet valve and because the inlet spring 36 is stronger than the exhaust spring 34*a*, it closes the exhaust valve 34 as the piston nears TDC when a cylinder clearance, e.g., about 0.10 inch is reached after which an abrupt pressure rise occurs in the remaining cylinder clearance volume of the steam expansion chamber 39 that together with pressure developed in recess is sufficient to crack open the inlet valve raising it slightly off its seat so as to produce an almost instant injection of supply pressure steam across the entire bottom face of the inlet valve which drives the inlet valve fully open, often in less than 1 millisecond. Because the plunger 32 is not high enough to contact the opposed inner surface of the recess 30*c* at TDC, there is no physical contact pressure exerted by the plunger against the inlet valve and thus no shock wave or clicking valve tappet type noise and no wear of the kind exhibited by previous piston-actuated inlet valves. The valves of the present invention are therefore relatively silent as well as having an extended service life.

During operation, as the plunger 32 enters the recess 30*c*, steam present in the recess is compressed adiabatically as the piston approaches TDC. When the plunger nears the recess, it will be located in the cylinder in axial alignment with the recess. The inclined vector forces from the connecting rod that might tend to move the piston toward the cylinder wall or tilt the piston are greatest when the piston is in mid-stroke but are absent at the upper end of each stroke where an upward inertial force aligns the piston with the cylinder and therefore acts to align the plunger with the recess. To facilitate entry of the plunger into the cylindrical recess, the mouth of the recess is enlarged slightly by having an outwardly inclined wall or chamfer at its opening. To further optimize plunger and recess alignment, the piston rings 12*a* and 12*b* are preferably backed by circular leaf springs (not shown) encircling the piston to keep the piston centered and out of contact with the cylinder 16 so that in some embodiments only the piston rings touch the cylinder wall.

To improve alignment and compression, the plunger can be covered if desired by a resilient cup-shaped cap 46 (FIG. 4) comprising a sheet metal stamping, e.g., spring steel held in place by a screw 48 passing through a slightly larger opening in the cap. The sidewall of the cap can be made with a close fit in the recess 30*c*. Alternatively, the plunger 32 can be encircled by a compression ring groove containing a resilient compression ring (not shown) chamfered at its upper edge.

In one embodiment of the invention using a 1.5 inch diameter titanium exhaust valve weighing 0.05 lbs., an exhaust spring 34*a* with a 15-20 lb. opening force is used. Therefore, as soon as the recess 30*c* pressure reaches 11.4 psi, the exhaust valve will begin to close. During operation as the plunger enters the recess and slides from a point 0.125 inch from the inner end wall of the recess to 0.035 inch from it, a distance of 0.090 inch, the pressure in the recess is capable of rising to over 67 psia assuming a reversible isentropic process in which steam is compressed adiabatically from 14.7 psia. However, since the applied force cannot exceed the force of the exhaust spring 34*a*, for example 15-20 lbs. the pressure reached in recess 30*c* at TDC will easily close the exhaust valve 34. Once the exhaust valve is closed, continued movement of the piston toward TDC another 0.090 inch to a clearance of 0.035 inch would be able to raise pressure in the expansion chamber 39 itself from its lowest value to a potential 50 psia or more as the inlet valve 14 opens which of course is not possible due to the opposing spring force of only 40 lbs. Therefore a much lower pressure would easily open valve 14. Without physical contact needed to open the valve, there is little valve noise or wear. Thus in summary the exhaust valve closes with cushioning provided by vapor compressed in recess 30*c* of the inlet valve 14 which in turn causes the build-up of pressure in the clearance volume of the expansion chamber 39 until the pressure rises high enough to open the inlet valve 14 not by contact pressure but by steam pressure in the recess and in the steam expansion chamber 39.

Very little steam pressure is needed in the present invention to crack open the inlet valve. For example, using a 40 lb. inlet spring 36 on a 4 inch diameter inlet valve 14, the steam pressure needed to open the inlet valve can be considered negligible at 3.18 psig (40/12.566 inch$^2$). Thereafter, as described in the Applicant's U.S. Pat. No. 8,448,440, once valve 14 is cracked open only slightly, its lower surface is exposed to a blast of high pressure steam providing a steam assist force at supply pressure to the lower end of the valve 14 which tests show can drive the inlet valve from a closed position to fully open in some embodiments of the invention in less than 1.0 millisecond responsive to the steam assist force. This greatly improves efficiency by eliminating losses previously caused by flow restriction through the inlet valve which can take one half of a crank rotation when an eccentric or cam is used as well by avoiding losses due to reverse torque inherent in ordinary high compression uniflow engines and by increasing the work output area displayed in pressure vs. volume tracings taken from engines tested by the Applicant that employ valves which after being slightly opened are opened the rest of the way by a supply steam assist force applied to an end thereof as in the present invention and as described in U.S. Pat. Nos. 8,448,440, 9,316,130 and application Ser. No. 15/077,576 all of which are assigned to the present Applicant and fully incorporated herein by reference. The piston operated valves described herein are not only simpler in construction and lower in cost but perform better than cam operated valves due to the energy saving that results from the improved thermal efficiency they provide.

Axial alignment of the exhaust valve plunger 32 with the recess 30*c* can be set by providing alignment pins (not shown) positioned to extend between the cylinder head and the cylinder or alignment can be made during assembly by placing the plunger inside the recess to align it while the cylinder head bolts 20 are being tightened down within oversized openings 23 in the cylinder head that enable the head to move slightly in any direction on the cylinder to assume the correctly aligned position established by the plunger within the recess as the bolts are tightened.

Figures 8, 9:
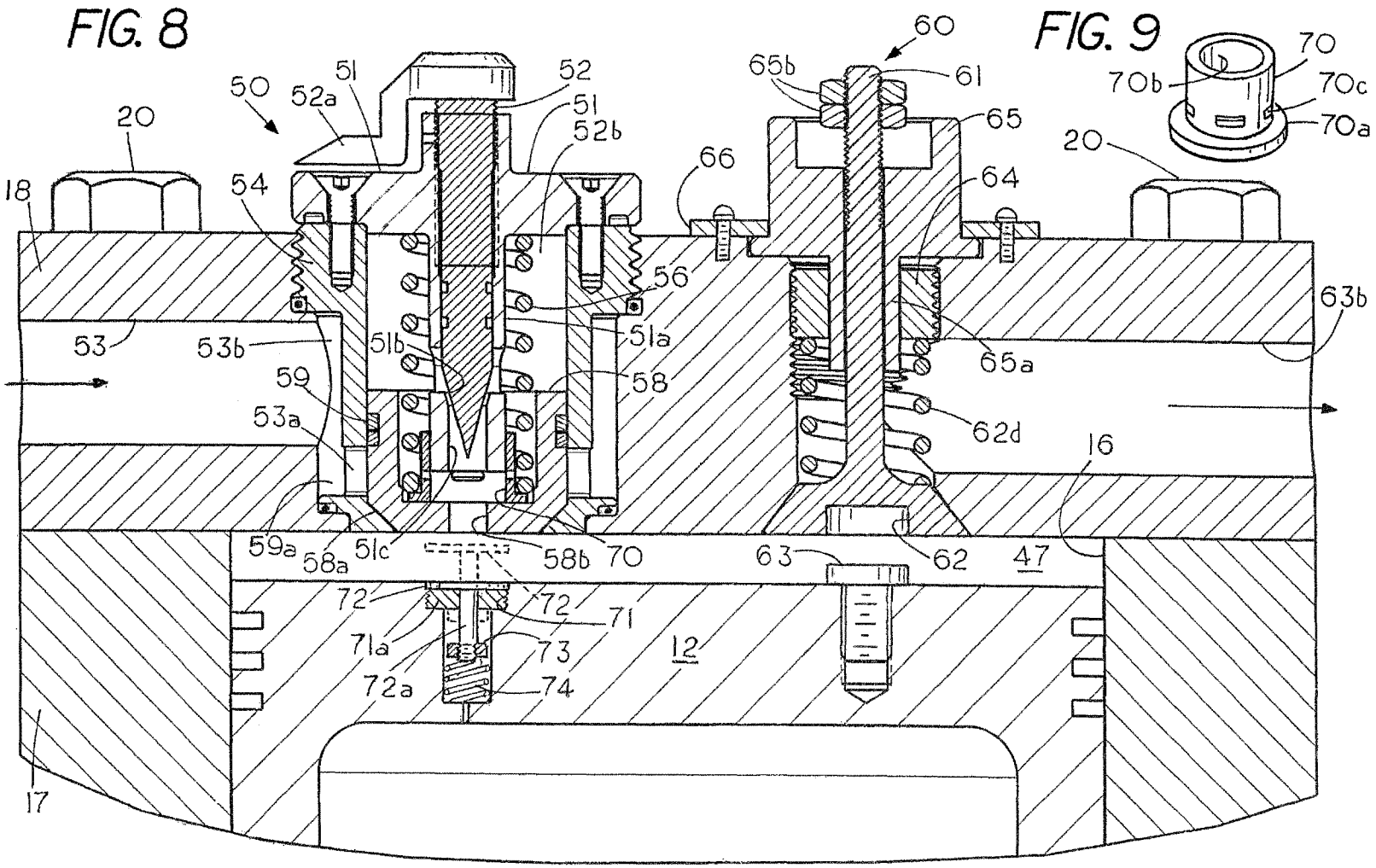
FIG. 8 is a vertical cross sectional view of another form of the invention on the scale of FIG. 5.
FIG. 9 is a perspective view of the sleeve 70 shown in FIG. 8.

Refer now to FIG. 8 which shows another embodiment of the invention. The cylinder head 18 which is secured to the engine block 17 by bolts 20 contains both the inlet valve assembly indicated generally at 50 and the exhaust valve assembly 60. Steam is supplied to the inlet valve assembly 50 through a supply duct 53 in the cylinder head and steam is exhausted from the exhaust assembly 50 through exhaust duct 63*b*. The piston 12 is slidably mounted in the cylinder 16 and is operatively connected to a crankshaft by means of a connecting rod as shown in FIG. 3.

The inlet valve assembly 50 comprises a housing 54 which is enclosed at the top by a cover 51 that is provided with an integral casing 51*a* in which a cutoff timing control needle 52 having a pointer 52*a* is threaded at its upper end so that it can be moved up and down by turning the needle 52 to open or close a cutoff control gap at a valve seat 51*b* within a duct 51*c*. Openings in the casing 51*a* just above the valve seat 51*b* allow steam to pass up from steam expansion chamber 47 through an opening 58*b* in a valve body 58 having compression rings 59 into the duct 51*c* through the gap at valve seat 51*b* and into a valve timing control chamber 52*b*. During operation, steam entering the engine through duct 53 passes into a chamber 53*b* then through a ring of several ports 53*a* into the steam expansion chamber 47 above the piston 12 when the valve body 58 is elevated from a valve seat 58*a* that surrounds an inlet opening at the lower end of the housing 54 until it seals against the lower end of the casing 51*a* which acts as a stop.

A bypass prevention sleeve 70 having a center bore 70*b* shown in FIG. 9 is slidably mounted on the casing 51*a* and is held in place by an inlet valve seating spring 56 contacting a flange 70*a* to direct steam passing from the steam expansion chamber 47 through a opening 58*b* and into duct 51*c* past the valve seat 51*b* and then into the cutoff control chamber 52*b*. If the sleeve 70 were not there, some steam would be free to pass directly into the control chamber 52*b* bypassing the control needle 52. Several vent openings 70*c* are positioned in the sleeve 70 so that they are open when the inlet valve body 58 is seated as shown in FIG. 8 but are closed by the casing 51*a* as soon as sleeve 70 begins to slide upwardly directing virtually all the flow through bore 70*b* up past the needle. However when the valve body 58 is closed, the pressure will drop in the cutoff control chamber 52*b* as steam flows down through the vent openings 70*c* during the exhaust stroke so that the control chamber 52*b* pressure is low at the end of the exhaust stroke and therefore is ready for the next power stroke to begin with inlet valve body 58 being raised as steam begins to fill cutoff control chamber 52*b* until the pressure therein is high enough to enable spring 56 to close valve body 58 at the time selected by needle 52.

On the upper surface of the piston 12 in alignment with the valve body 58 is an inlet valve port plug 72 that is slidably mounted within a guide 71*a* which is threaded at 71 into the top of the piston. The plug shaft 72*a* has a nut 73 that is yieldably biased upwardly by a spring 74 to normally place the plug in the dotted line raised position as shown so as to contact and temporarily seal port 58*b* as the piston approaches TDC. This prevents steam that is being compressed in the chamber 47 from entering the control chamber 52*b* before TDC. Cylinder pressure holds the plug 72 down during the power stroke.

Figure 6:
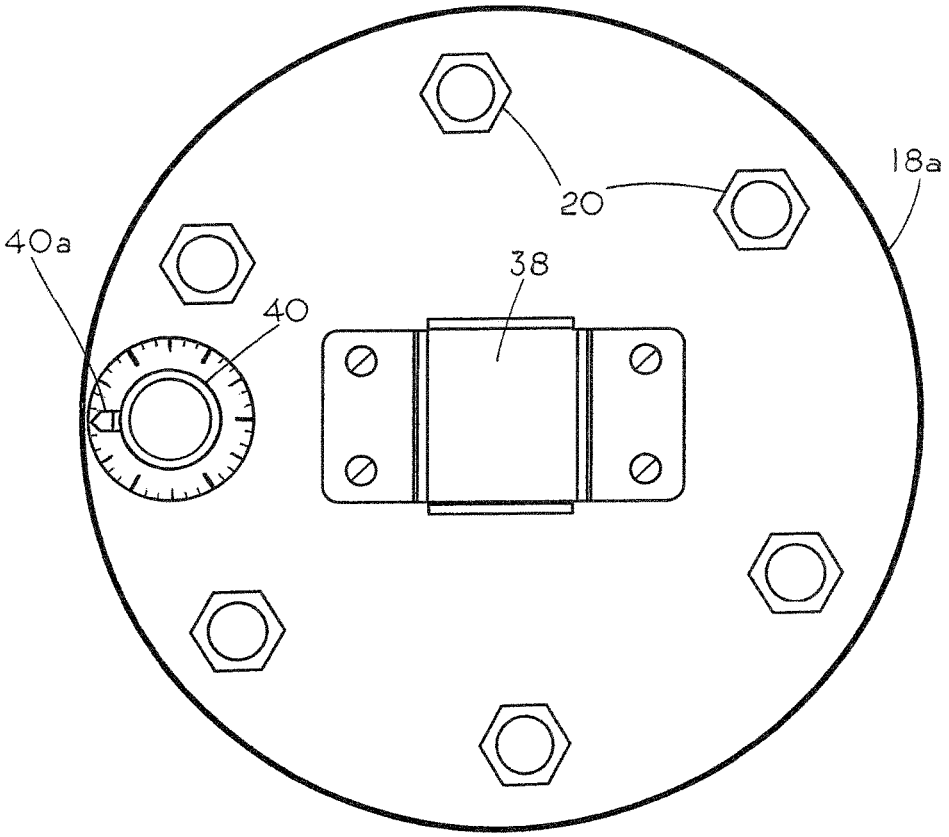
FIG. 6 is a top view of FIG. 3 on a larger scale.
Figure 7:
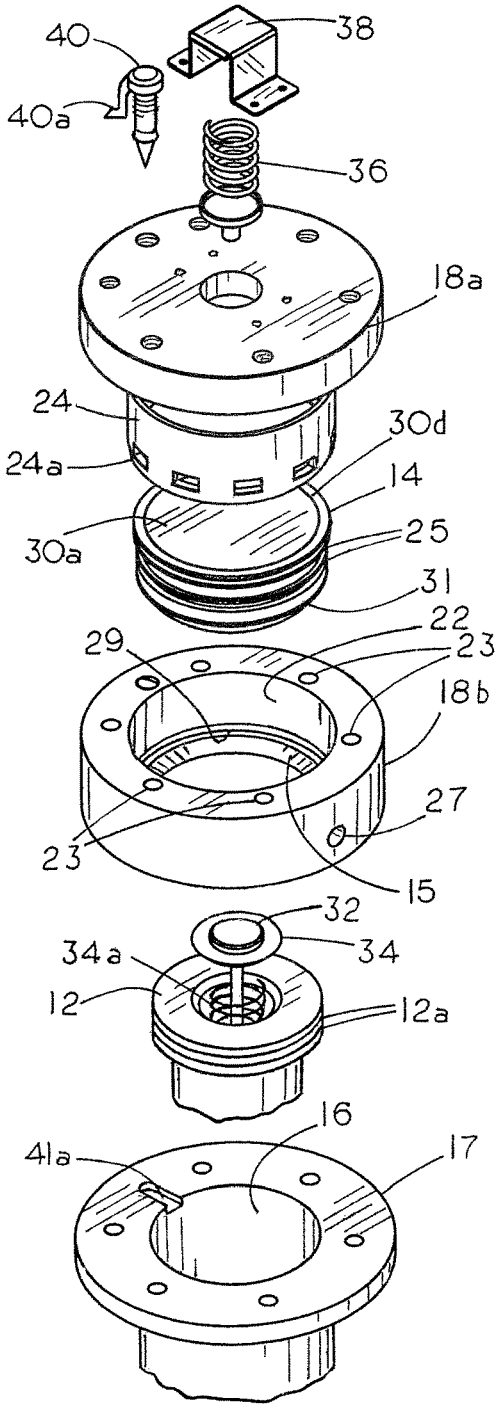
FIG. 7 is an exploded view of the invention as shown in FIGS. 3-6 on a reduced scale.

The exhaust valve assembly 60 includes a poppet exhaust valve 61 with a valve head at its lower end which is provided with an upwardly extending inwardly facing cylindrical recess 62 within the valve head that is aligned with a disk shaped plunger 63 which extends upwardly from the top of the piston 12 in position to enter the recess 62 when the piston approaches TDC. The exhaust valve 61 is yieldably biased downwardly to an open position by a spring 62*d*. Spring tension can be adjusted and set manually by means of a knob 65 having an inward extension 65*a* acting as a valve guide with a hexagonal outer surface that extends through a hexagonal opening in a nut 64 which is threaded within an opening in the cylinder head 18. The knob 65 is held for rotation on the top of the cylinder head by means of a retaining ring 66 that is fastened to the head by screws. Lock nuts 65*b* are adjusted to control the lift distance of valve 61. As in FIGS. 3-7, a valve actuation assembly comprising a compression compartment is defined by a recess and a plunger except in this case the recess is in the exhaust valve. Except for actuation, valves similar to valves 50 and 60 are described in Applicant's U.S. Pat. No. 8,448,440 (FIG. 6).

The compression clearances and operation of FIG. 8 is similar to that described above concerning FIGS. 3-7 except that the exhaust valve 61 which is located in the cylinder head rather than in the piston is closed by the plunger 63 on the piston. This is done by trapping residual steam in the recess 62 provided within the exhaust valve as the plunger enters the recess. As the piston approaches TDC the port plug 72 seals port 58*b*. After the exhaust valve closes due to the steam pressure developed within the recess 62 and without the plunger contacting the opposed wall of the recess within the exhaust valve, the operation is the same as described above with reference to FIGS. 3-7. Since there is no physical contact between the plunger and the downwardly facing wall of the recess 62, there is again no shock wave or valve tappet type noise nor the kind of wear experienced by previous piston-actuated inlet or exhaust valves. This enables the valves to be silent and provide an extended service life.

It will be noted that the possibility of a lock-up of the piston due to an incompressible condensate remaining in the expansion chamber (hydrolock) is impossible in FIGS. 3-7 because the inlet valve 14 is spring loaded. In FIG. 8, hydrolock can be avoided by the space in recess 62 that remains at TDC which can hold condensate and by eliminating water from the steam expansion chamber. Sufficient superheat is used to avoid significant condensation upon start-up. A solenoid operated purge valve or condensate trap of known-construction (not shown) can also be placed in the steam inlet pipe to eject condensate. Numerous variations of the invention within the scope of the appended claims include, for example, replacing the cutoff control valve and chamber with an electrical inlet valve control unit as in Applicant's prior U.S. Pat. Nos. 8,448,440, 9,316,130, 9,784,147 and application Ser. No. 15/077,576 in which valve operation timing is set by an electromagnet operatively associated with a ferromagnetic armature connected to the inlet valve and an electronic control unit having an engine phase transducer or pick-up to detect the timing of each cylinder.

Many other variations within the scope of the appended claims will be apparent to those skilled in the art once the principles disclosed herein are read and understood.

What is claimed is:

1. A steam engine in which at least one valve is operated by piston movement comprising:

a cylinder having a piston slidably and sealingly mounted therein and operatively connected to a crankshaft;

a cylinder head at one end of the cylinder that includes at least one valve therein which comprises a steam inlet valve slidably mounted and yieldably biased to move in the direction of the piston to a closed position on a valve seat in the cylinder head;

a steam exhaust valve that is slidably mounted within the engine and is yieldably biased to an open position during an exhaust stroke;

a valve actuation assembly;

wherein the valve actuation assembly comprises:

a steam compression compartment defined between a plunger and a recess within the engine that is closed at one end and is open at the other end, the plunger being aligned to enter the recess through the open end of the recess for pressurizing steam within the steam compression compartment;

wherein the valve actuation assembly is operatively associated between the piston and the cylinder head;

the valve actuation assembly is constructed and arranged such that the plunger and the recess remain out of engagement with one another during an exhaust stroke until entry of the plunger into the recess proximate an end of the exhaust stroke;

whereupon steam supplied to the engine that is located in the steam compression compartment within the recess is pressurized due to a movement of the piston and the entry of the plunger into the recess; and whereupon the pressurized steam within the steam compression compartment closes the exhaust valve and opens the inlet valve proximate the end of the exhaust stroke in the absence of physical contact between both a) the closed end of the recess and the plunger, and b) between the piston and the inlet valve.

2. The steam engine of claim 1, wherein the plunger is mounted on a head of the exhaust valve and the recess is located in a face of the inlet valve confronting the exhaust valve.

3. The steam engine of claim 2, wherein the exhaust valve is a poppet valve yieldably biased to an open position in a head of the piston in alignment with the recess in the steam inlet valve and the plunger is on a head of the exhaust valve.

4. The steam engine of claim 1, wherein the plunger extends from a top surface of the piston and the recess is located within a face of the exhaust valve that confronts the plunger.

5. The steam engine of claim 1, including a timing duct extending through the inlet valve that communicates with a steam expansion chamber in the cylinder and an inlet valve port plug is mounted on the piston to contact the inlet valve and thereby seal the timing duct when the piston approaches the cylinder head.

6. The steam engine of claim 5, wherein the inlet valve port plug is a spring biased valve slidably mounted in the piston in position to cover an open end of the timing duct on a surface of the inlet valve facing the plug.

7. The steam engine of claim 5, wherein the steam inlet valve and the exhaust valve are mounted in spaced apart positions in the cylinder head, the inlet valve port plug and the plunger are mounted on a head of the piston in spaced apart positions such that the valve port plug is aligned with the steam inlet valve and the plunger is aligned with the recess, said recess being located in the exhaust valve.

8. The steam engine of claim 1, wherein the inlet valve has a hollow valve body with axially spaced apart top and bottom surfaces that are joined by an annular sidewall.

9. The steam engine of claim 1, wherein the steam inlet valve is surrounded by a ring of steam inlet ports communicating with a steam supply inlet that leads to a bore in which the steam inlet valve is slidably and sealingly mounted within the cylinder head of the engine; and wherein a steam inlet valve seat is separated from the ring of steam inlet ports by a space and the valve body has a circumferential groove holding a resilient compression ring that is aligned with said space when the inlet valve is in contact with the inlet valve seat thereby reducing a flow of steam through the ports into the cylinder as the valve begins to lift off of the inlet valve seat during operation.

10. The steam engine of claim 1, wherein the plunger has a circular cup shaped cover comprising a sheet metal stamping secured to a free end of the plunger.

11. The steam engine of claim 1, wherein the inlet valve is a spool valve having a different cross sectional diameter at each end thereof to enable the spool valve to open when a cylinder pressure at an end of the spool valve facing the cylinder exceeds the pressure at an opposite end of the spool valve and enables the spool valve to close when the pressure is equal at each end of the spool valve.

12. The steam engine of claim 1 in which at least one valve is operated by piston movement further comprising;

an adjustable cutoff control valve within a valve casing having a steam cutoff control passage therein that has an end aligned with an opening in the valve body and a steam bypass prevention sleeve is slidably mounted with the casing and in communication with the opening in the inlet valve body to direct steam passing through the opening in the inlet valve body into the passage through the casing.

13. A method of activating a steam engine valve responsive to piston movement comprising steps of:

providing a steam engine cylinder having a piston therein, a cylinder head that is located at one end of the cylinder and a steam expansion chamber between the cylinder head and the piston;

providing a steam inlet valve comprising a poppet valve that is held by a yieldable biasing force to a closed position and a poppet exhaust valve wherein both valves communicate with the steam expansion chamber;

maintaining the exhaust valve open during an exhaust stroke as the piston moves toward the cylinder head;

closing the exhaust valve proximate but prior to an end of an exhaust stroke whereby a residual quantity of steam is then compressed in the steam expansion chamber during a terminal fraction of the exhaust stroke prior to top dead center; and maintaining the piston clearance at top dead center sufficiently small that the steam is compressed in the expansion chamber during the terminal fraction of the exhaust stroke to a pressure sufficient to at least partially open the inlet valve against the yieldable biasing force on the inlet valve in the absence of a physical contact force applied by the piston to the inlet valve.

14. The method of claim 13 including the step of providing a valve actuation assembly comprising a plunger positioned in alignment with a cooperating recess that is operatively associated with the plunger for compressing steam in a steam compression compartment between the plunger and the recess to a pressure sufficient to close the exhaust valve in response to piston movement such that steam is then pressurized in the steam expansion chamber responsive to continued movement of the piston toward the top dead center position.

15. The method of claim 13, wherein when the inlet valve is at least partially opened, the inlet valve is opened fully by a steam assist force provided by steam pressure applied to an end of the steam inlet valve.

16. The method of claim 13, including the step of maintaining a selected piston clearance at top dead center that is at or below 0.050 inch.

17. The method of claim 13, including the step of providing a preliminary exhaust valve comprising at least one exhaust port in the cylinder positioned to communicate with the steam expansion chamber when the piston reaches a bottom dead center position to thereby exhaust steam from the cylinder through the at least one port.

18. A steam engine comprising:

at least a steam inlet valve and a steam exhaust valve is operated by a piston movement to admit and to discharge steam respectively;

a cylinder having a piston slidably and sealingly mounted therein and operatively connected to a crankshalt;

wherein the steam inlet valve comprises:

a valve body slidably mounted in a bore within the engine with at least one port in the bore for admitting the steam into the bore and a cutoff control for closing the steam inlet valve at a selected fraction of a power stroke of the piston; and a compression ring around the inlet valve body that is positioned between the port in the bore and a valve seat for the inlet valve body when the valve body is in contact with the valve seat thereby inhibiting a premature transfer of steam into a seal area between the valve body and the valve seat while the inlet valve is closed.

* * * * *